US007591307B2

(12) United States Patent
Gibson

(10) Patent No.: US 7,591,307 B2
(45) Date of Patent: Sep. 22, 2009

(54) METHOD OF AND SYSTEM FOR DETERMINING THE FREE POINT IN A DRILL PIPE

(75) Inventor: James Garland Gibson, Broussard, LA (US)

(73) Assignee: Sondex Ltd, Yateley, Hampshire (GB)

( * ) Notice: Subject to any disclaimer, the term of this patent is extended or adjusted under 35 U.S.C. 154(b) by 326 days.

(21) Appl. No.: 11/518,392

(22) Filed: Sep. 7, 2006

(65) Prior Publication Data

US 2008/0060808 A1 Mar. 13, 2008

(51) Int. Cl.
*E21B 47/09* (2006.01)

(52) U.S. Cl. ..... 166/250.13; 166/66.5; 175/40

(58) Field of Classification Search ..... 166/250.13, 166/66.5; 175/40
See application file for complete search history.

(56) References Cited

U.S. PATENT DOCUMENTS

| | | | | |
|---|---|---|---|---|
| 2,902,640 | A | 9/1959 | Foster | |
| 3,004,427 | A | 10/1961 | Berry | |
| 4,440,019 | A | 4/1984 | Marshall | |
| 4,444,050 | A | 4/1984 | Revett | |
| 4,675,029 | A | 6/1987 | Norman et al. | |
| 4,766,764 | A * | 8/1988 | Trevillion | 73/152.56 |
| 5,479,989 | A | 1/1996 | Shy et al. | |
| 5,564,502 | A | 10/1996 | Crow et al. | |
| 5,622,223 | A | 4/1997 | Vasquez | |
| 5,741,962 | A | 4/1998 | Birchak et al. | |
| 5,758,724 | A | 6/1998 | Amerman | |
| 6,065,540 | A * | 5/2000 | Thomeer et al. | 166/297 |
| 6,250,371 | B1 | 6/2001 | Amerman et al. | |
| 6,594,394 | B1 | 7/2003 | Stroemberg et al. | |
| 6,672,371 | B1 | 1/2004 | Amerman et al. | |
| 6,694,766 | B1 | 2/2004 | Johnson, Jr. et al. | |
| 6,955,219 | B2 | 10/2005 | Johnson, Jr. | |
| 7,093,657 | B2 | 8/2006 | Johnson, Jr. | |
| 7,270,182 | B2 | 9/2007 | Johnson, Jr. | |

(Continued)

FOREIGN PATENT DOCUMENTS

EP 0 196 829 A2 10/1986

(Continued)

OTHER PUBLICATIONS

Search Report from the UK Patent Office dated Sep. 6, 2007 (4 pages).

(Continued)

*Primary Examiner*—William P Neuder
(74) *Attorney, Agent, or Firm*—GE Global Patent Operation

(57) ABSTRACT

A method of determining the stuck point in a bore hole is provided. The method employs a device, such as an inductor or coil, for writing magnetic marks into the bore hole casing. The device is incorporated into a retrieval tool so that when a decision is taken to back off from the bore hole and recover any down hole equipment, the magnetic marks can be written on the casing of the bore hole as the retrieval tool is lowered into place. As the retrieval tool is raised in the bore hole, lifting the down hole equipment towards the surface, the magnetic marks are read using a three dimensional magnetic field sensor disposed either in the fishing tool or in the down hole apparatus itself.

14 Claims, 2 Drawing Sheets

U.S. PATENT DOCUMENTS

| | | | | |
|---|---|---|---|---|
| 2002/0070017 | A1 | 6/2002 | Soliman et al. | |
| 2002/0104643 | A1 | 8/2002 | Amerman et al. | |
| 2004/0031585 | A1 | 2/2004 | Johnson, Jr. et al. | |
| 2004/0194914 | A1 | 10/2004 | Johnson, Jr. et al. | |
| 2005/0240351 | A1 | 10/2005 | Gray | |
| 2005/0269081 | A1 | 12/2005 | Rose | |
| 2006/0122780 | A1 | 6/2006 | Cohen et al. | |
| 2007/0012446 | A1 | 1/2007 | Johnson, Jr. | |
| 2008/0042870 | A1* | 2/2008 | Orban et al. | 340/854.2 |

FOREIGN PATENT DOCUMENTS

| | | | |
|---|---|---|---|
| EP | 0 692 610 | A2 | 1/1996 |
| EP | 1 647 669 | A1 | 4/2006 |
| EP | 1644671 | | 4/2006 |
| GB | 2 158 245 | A | 11/1985 |
| NO | 20022539 | | 7/2002 |
| WO | WO 86/03141 | | 6/1986 |
| WO | WO 99/63282 | | 12/1999 |
| WO | WO 2004/044615 | A2 | 5/2004 |
| WO | WO 2005/062196 | A2 | 7/2005 |

OTHER PUBLICATIONS

Prior Art Search on "espacenet" dated Jun. 9, 2007 (8 pages).

* cited by examiner

METHOD OF AND SYSTEM FOR DETERMINING THE FREE POINT IN A DRILL PIPE

The invention relates to a method of and system for determining the free point in a drill pipe.

Drill pipes are used in the extraction of natural resources such as oil, water, gas and other hydrocarbons from underground deposits. In a drilling operation, a rotating drill bit is used to create a bore hole or well extending from the surface, through intervening layers of earth or rock, to a deposit. A metal drill pipe is used to line the bore hole and is added in sections as the drilling progresses. Individual sections of the drill pipe may be secured to each other by screwing together threaded connector portions. The threaded sections are generally referred to as collars, as the external diameter may be locally increased.

The drill pipe sections are inserted into the bore hole from the surface. However, as they are lowered into the bore hole, it is possible that one or more of the sections will become wedged in a restriction in the earth or rock formation. The location in the bore hole where this occurs is called the stuck point. The section immediately above the stuck point is referred to as the 'free point'.

The section of drill pipe that has become stuck is a problem, as it means that further drilling cannot continue. In such circumstances it is common practice to 'back off' and recover as much of the drill pipe and equipment as possible for later use, possibly abandoning the drill pipe below the stuck point and redrilling in a different direction from a higher point in the bore hole. This will require that the threaded collar immediately above the stuck point is identified, and that explosive charges are detonated to loosen the threads while reverse torque is applied. It is therefore desirable to determine the exact location of the stuck point.

A number of devices are known for this purpose, and will now be described by way of introduction. All such devices rely on the fact that torque or stretch, applied at the surface will be transmitted to all sections of the drill pipe above the stuck point, but to none below the stuck point.

U.S. Pat. No. 2,902,640 describes a device for determining whether a thread is responding to reverse torque, and illustrates the general principle. A device having an inductor, or sensor coil, and at least one bar magnet coaxially aligned with the sensor coil is paid out into the drill pipe. The ends of the coil are attached to a galvanometer at the surface so that any change in the magnetic field provided by the magnet will result in a change in the magnetic flux threading the coil and a detectable change in current measured by the galvanometer. The lines of magnetic flux generally flow though the metallic casing of the drill pipe. Thus, while ever the device moves though the drill pipe in locations away from a threaded section, the magnetic flux will stay constant, as the diameter and construction of the drill pipe section will not vary significantly. Where a threaded section occurs however, the lines of magnetic flux encounter the threading collar. The different diameter and construction of the drill pipe collar cause a resulting change in the lines of magnetic flux, as the coil moves relative to the collar. This change in the magnetic field causes an induced current to flow in the sensor coil which can be detected at the surface to indicate that the device is located at a threaded connector portion. The device is then held in position, while a torque is applied at the surface. If the threaded connector portion is free to move, the resulting motion of the threads of the two drill pipe sections will cause a further disruption in the magnetic field with a corresponding induced current being generated in the sensor coil. By detecting this second current signal, coincident with the application of the torque, the threaded section can be determined as being free to move. However, if the threaded sections are jammed then the application of the torque will not cause any motion, and no current signal will be detected coincident with the application of the torque. This method suffers from the fact that the threads at the selected collar may well be firmly locked, while threads higher up may be less tight, and hence undo themselves before the test can be made.

U.S. Pat. No. 3,004,427 shows a more complicated device that works on similar principles. The device has two connected axially rotatable sections, each carrying one of two co-operating cores. The cores are located adjacent each other and mounted for independent rotational movement. The relative position of the co-operating cores with respect to each other is initially set by applying a direct current to a coil located on one of the cores. In doing so, that core becomes magnetised and attracts the other into a start position. If the upper section of the device is located in part of the drill pipe that is free to move, and the lower device section is located in a part that is stuck, then a torque applied to the drill pipe will cause the upper section of the device to rotate away from the lower section. The two cores also therefore rotate away from each other causing an air gap in the magnetic circuit, and hence a significant change in the self inductance of the sensor coil, which is excited with an AC voltage during the test. If the two sections of the device are both located in a stuck section of the drill pipe, then there is no relative motion of the two cores and no change is detected.

Both of these devices require stationary measurements to be made at a series of individual locations in the bore hole, so that location of the stuck point is a laborious and iterative process.

Another device with a different mode of operation is also known from U.S. Pat. No. 4,440,019. The device writes magnetic spots or marks along the length of the wall of the drill pipe by discharging a surface capacitor bank through a sensor coil. The effect is similar to the writing of a signal onto magnetic tape. Once the marks have been made, the device is recovered and lowered once again into the drill pipe, while the location of the magnetic spots is logged using the sensor coil. The movement of the sensor coil past the magnetic mark causes an induced voltage in the sensor coil, indicating the position of the mark for a sensor log. A twisting or longitudinal force is then applied to the drill string causing stress in the string. The induced strain has been found to substantially erase all of the magnetic spots above the stuck point. The device is then reinserted into the bore hole to measure the location of the magnetic marks once again. As all of the spots above the stuck point will have been erased, the location of the stuck point can be deduced from comparison of the logs before and after the drill pipe was flexed, and in particular from the position of the highest remaining magnetic mark in the second log.

This device suffers from a number of problems. First, it is necessary to rig up and lower a fishing tool to retrieve the expensive measurement equipment from the vicinity of the drill bit. Then, it is necessary to rig up and lower, often on a different cable, the device to make two or three excursions into the drill pipe, first to write the magnetic marks, and subsequently to read them before and after the tension is applied. Also, the strength of the magnetic mark that is detected depends on the speed at which the detector coil passes through the magnetic field in the pipe. In order to produce a good signal and a reliable log, it is therefore necessary to move the sensor coil at substantially the same speed while the logs are being produced. The coil sensitivity is in practice also limited.

The running costs of a drilling rig dictates that a drilling company locate the position of a stuck point with minimum delay. In view of the above problems, we have therefore appreciated that there is a need for an improved method of determining the stuck point, and an improved system for use with the method, that saves time and is more sensitive.

SUMMARY OF THE INVENTION

The invention is defined in the independent claims to which reference should now be made. Advantageous features of the invention are set out in the dependent claims.

BRIEF DESCRIPTION OF THE DRAWINGS

Preferred embodiments of the invention will now be described by way of example with reference to the drawings, in which.

DETAILED DESCRIPTION OF THE PREFERRED EMBODIMENTS

A preferred embodiment of the invention will now be described with reference to FIG. 1.

Figure 1:
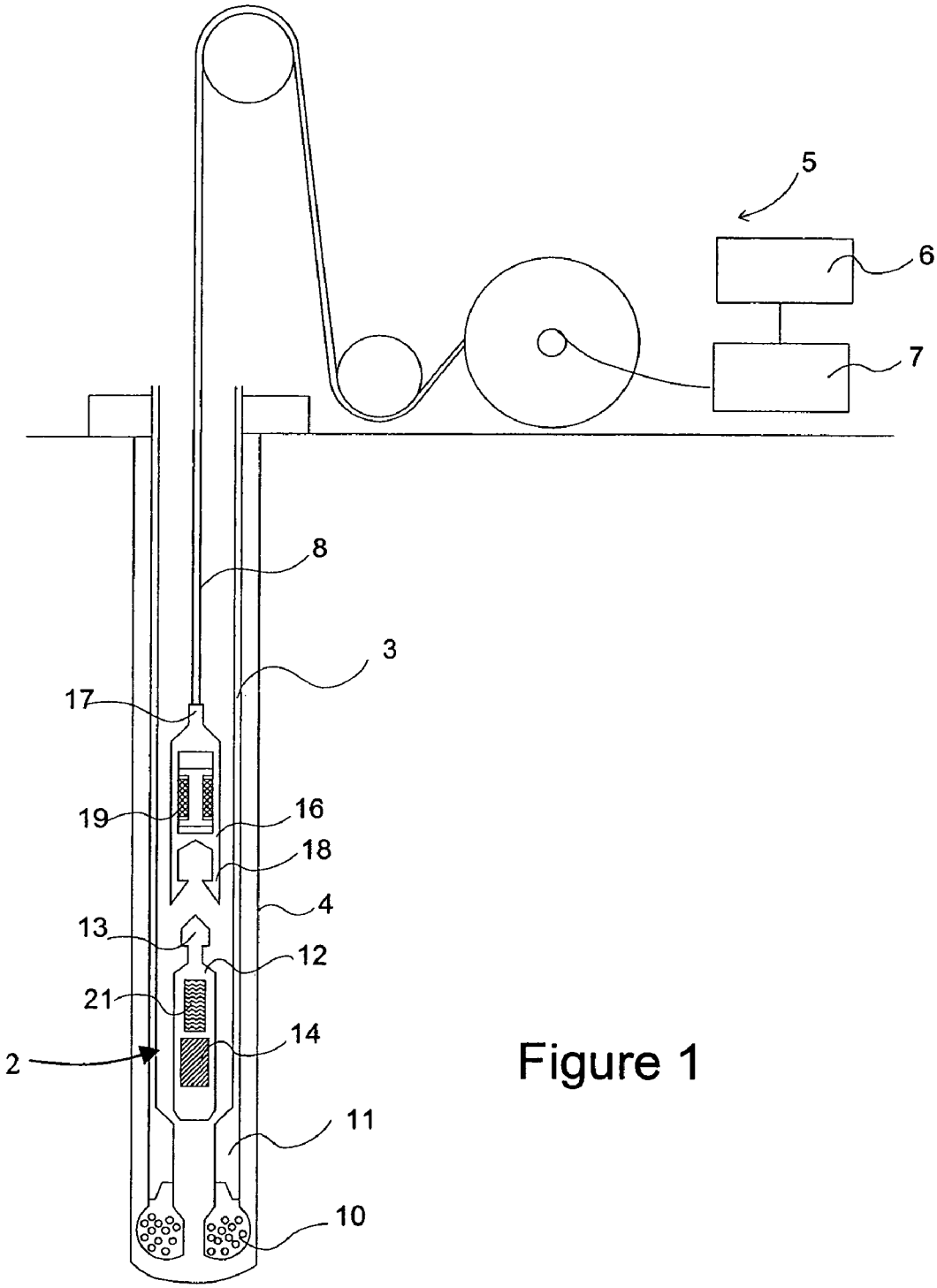
FIG. 1 is an illustration of a drill collar and bit, and an attached measurement-while-drilling (MWD) apparatus, according to a preferred embodiment of the invention.

FIG. 1 illustrates a down-hole device 2 located in the bore hole 4 of a well. The well extends into the ground from a surface station 5 at which various control apparatus 6 and recording apparatus 7 is situated. As is known in the art, control signals may be sent from the surface station to the down hole device 2 by means of mud pulsing or other telemetry. Mud pulsing refers to a technique in which data is coded as a series of pressure pulses created in the mud flowing in the bore hole. A mud pulser at the surface or on the device creates a pulse which then propagates along the bore hole to a receiver.

The down hole device 2 is located within the drill pipe or casing 3 within the bore hole. At the bottom end of the drill pipe is a drill bit 10 mounted on one or more heavy drill collars 11. The drill bit and collar, and the drill pipe, form what is known as a drill string. In FIG. 1, the down hole device 2 is shown only to comprise a measurement-while-drilling (MWD) sensor 12, and additional apparatus 14, such as spacers, centralising apparatus and shock absorbing apparatus. Such apparatus is illustrated generally in FIG. 1 as component 14.

Figure 2:
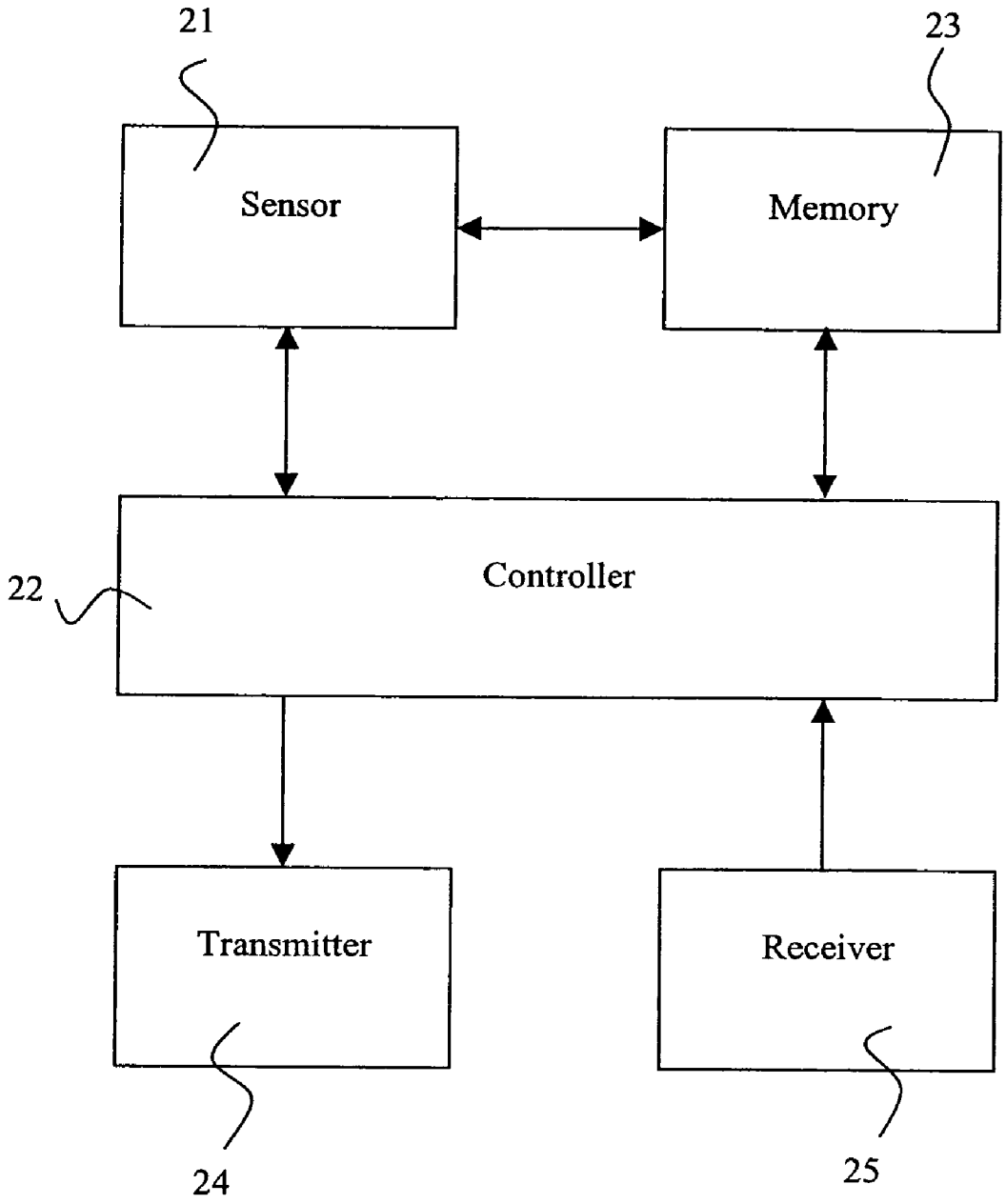
FIG. 2 is a schematic illustration of the constituents of a preferred magnetic field sensor provided in the MWD sensor of FIG. 1.

An MWD sensor is a device for taking periodic measurements of the down hole conditions in the bore hole and transmitting the resulting data to the surface for confirming the direction of drilling and other analysis. The sensor data will often be transmitted to the surface via a mud pulse, created by a mud pulser apparatus in the vicinity of the sensor. The pulse then propagates upwards in the bore hole to the surface recording device 7. The measurements may also be stored in memory in the MWD sensor and retrieved when the sensor is recovered from the well. Typically, an MWD sensor will include a sensitive magnetic field sensor 21 and associated control circuitry for detecting the magnetic field strength in the bore hole in three dimensions. In doing so, the orientation of the drill bit relative to the magnetic field of the earth can be determined. The MWD device of the preferred embodiment however comprises modified control circuitry for operating the sensor. This will now be described in more detail with reference to FIG. 2.

Sensor 21 is a three dimensional magnetic field sensor. These typically comprise three individual sensors, each orientated with respect to the others to detect the magnetic field strength in a respective one of the x, y and z directions. Various types of magnetic field sensor could however be used, such as sensitive flux-gates, magnetoresistive devices, Hall Effect devices, or any static sensing directional magnetometer.

Sensor 21 is connected to control unit 22, and to memory unit 23. The control unit 22 is further connected to the memory unit 23, and to transmitter device 24 and receiver device 25. According to the preferred embodiment of the invention, the control unit and sensor have two distinct modes of operation. The first mode provides an indication of the underground orientation of the drill string with respect to the magnetic field in known fashion. In this mode, the control unit 22 is arranged to take periodic measurements via the sensor and operate the transmitter device 24, typically a mud pulser, such that the measurements are transmitted to the surface. The second mode is activated only when the drill bit or drill pipe has become stuck, and the MWD sensor is to be retrieved from the bore-hole. As explained above, it will be appreciated that although a drill bit that has become stuck may be abandoned it is desirable to recover as much of the expensive equipment used in the bore-hole as possible.

In the second mode, the magnetic sensor is configured to detect the stuck point of the drill pipe as will be explained below. In this mode, the control unit also takes measurements of the magnetic field, and stores these in memory 23 or transmits them to the surface. Preferably, the control unit is instructed to switch from the first mode of operation to the second mode of operation via a control signal received at receiver 25. This may be a mud pulse or other telemetry signal, or a command from the fishing tool via magnetic or electrical coupling.

In the first mode of operation, the control unit takes readings from the sensor at a rate reflecting the drilling tool's slow movement through the underground rock or earth formations. On switching to the second mode however, now made available by the preferred embodiment of the invention, the control unit 22 increases the rate at which readings from the sensor are taken, so as to correspond to the MWD sensor's much faster ascent in the bore hole when it is being retrieved. In the first mode, the sensors are read every 10 to 20 seconds, commensurate with the drill penetration rate through the rock or earth formation, in order to achieve 1 or 2 samples per foot of distance. During retrieval of the MWD sensor, the speed is 1500 to 3000 feet/hour, and the marks are ideally read at 0.5 inch intervals. The sampling rate in the second mode is therefore around 10 to 20 samples per second. In the preferred embodiment, the frequency of the first and second modes can therefore be seen to differ by around a factor of 100.

Referring again to FIG. 1, the preferred system also comprises a retrieval or fishing tool 16 connected to a wireline 8 by connector 17. It is common practice to refer to any object stuck in the bore-hole as a fish, and tools designed to retrieve such objects as fishing tools. The wireline 8 is arranged to carry control signals to and from the fishing tool, as well to physically position the device in the borehole. The other end of the fishing tool carries a fishing head or grapple 18 for engaging with a reciprocally shaped connector portion 13 of MWD device 12. Fishing tool 16 also comprises a device 19 for writing magnetic marks into the wall of the borehole. The writing device 19 comprises a coil of wire connected to a current supply, and one or more metal pole pieces to shape the magnetic field, and may therefore be identical to the coil arrangement of U.S. Pat. No. 4,440,019.

Control apparatus 6 may comprise a computer program arranged to control the operation of the down hole device 2, such as the MWD sensor, as well as or separately to the fishing tool 16. This or another computer program may be provided to operate on the data obtained from the magnetic field sensor in order to provide one or more traces indicating the position of the magnetic marks in the bore hole. This computer program may be provided at the surface or within either the down hole device 2 or fishing tool 16.

A preferred method for detecting the stuck point using the apparatus described above will now be described. With reference to FIG. 1, it is now assumed that the drill string has become stuck, and further drilling is no longer possible. Having decided to abandon the present drill bit, the aim is to retrieve the expensive down hole MWD equipment, and determine the location at which the drill pipe is stuck. The method for achieving this is as follows:

First, the fishing tool with the device 19 for writing magnetic marks is lowered into the bore-hole on the wireline. By means of the surface control systems, current is pulsed into the coil of the fishing tool at regular intervals so as to leave detectable magnetic marks in the metal drill pipe. The fishing tool is lowered into the borehole until the fishing grapple 18 contacts and engages with the connector 13 of the MWD sensor.

A control signal is sent to the MWD sensor to switch the device from the first sensing mode to the second sensing mode. As explained above, the length of time between readings is preferably smaller in the second mode than in the first, because the MWD sensor will move more quickly during the retrieval process, than when its motion is from the drilling action of the drill string. The switching command signal may be transmitted from the surface to the MWD device via mud pulse, or other means. In alternative embodiments, the command signal may be transmitted to the MWD sensor via the fishing tool. For example, once the two devices are connected, a signal may be transmitted by a direct electrical connection, such as a plug/socket connection, or indirectly via inductive or short-hop telemetry coupling.

Once the MWD device is operating in the second sensing mode, it is drawn upwards in the borehole by the fishing tool and the action of the wireline. The control unit takes readings from the magnetic field sensor and either stores these in memory or transmits them to the surface via the retrieval tool. A log of the positions of the magnetic marks in the borehole is produced. If the log is stored in memory, it may be recovered once the MWD device reaches the surface and is extracted from the borehole.

Once the MWD sensor has reached the top of the well, or thereabouts, a torque or pull is applied to the top of the drill pipe to erase or diminish the magnetic marks above the stuck point. The assembly of fishing tool and MWD sensor is then lowered into the borehole and retrieved once again. As before, the control unit takes readings from the magnetic field sensor as the MWD device is raised in the borehole and a log of positions of the magnetic marks in the borehole is produced. As is known in the art, comparison of the two records will then reveal that the marks above the stuck point, which have become stressed, have become weaker, allowing the precise location of the stuck point to be determined.

The use of a three dimensional magnetic field sensor means that a comparison can be made of the different directional field components of the magnetic marks, allowing greater detection sensitivity. The data obtained from the magnetic field sensors is therefore preferably input into one or more algorithms in order to give a number of different outputs or traces. Any or all of the algorithms may be employed to provide multiple log traces thus maximising the visibility of the stuck point when the two log passes are compared. Alternatively, the choice of algorithm may depend on the geometry of flux pattern created by the marking coil and the particular pole piece arrangements. Remembering that the three sensors are configured to give x, y and z signals (the z axis is in the longitudinal direction of the borehole, while the x and y axes are orthogonal) suitable choices of algorithm from which logs may be derived are:

1. The sum of the squares of the x, y and z signals;
2. The sum of the squares of the x and y signals;
3. The z signal only;
4. The sum of the squares of the x, y and z signals, together with the sign of the z signal; and
5. A fractional power, for example the square root, of 1, 2 or 4 above.

All of these algorithms provide a log signal which is insensitive to the rotational orientation of the tool along the axis of the borehole. This is important to achieve log consistency, as the sensors are likely to rotate around the longitudinal axis of the borehole during the logging process. Logs could be derived from one or more of the above, alone or in combination.

The technique described above allows the retrieval of the down hole equipment and the determination of the free point to be determined from only two excursions into the bore hole. This is in comparison with the three excursions necessary to retrieve the MWD and determine the stuck point in the prior art. A drilling company can therefore save considerable time and expense.

Additionally, as the sensing of the magnetic marks is achieved using the sensors of the MWD, the speed at which the MWD sensor is moved through the drill pipe does not affect the magnitude of the mark detected. Where a coil is used both to write the marks and detect them, the detected strength of the mark is dependent on the rate of change of the magnetic field not the actual strength of the mark itself.

A number of alternative methods and apparatus for determining the stuck point are also contemplated. For example, in an alternative embodiment the data obtained by the MWD sensor may be stored in the fishing tool, and/or transmitted to the surface by the wireline connection 8. Additionally, the fishing tool itself may be provided with a three dimensional magnetic field sensor to detect the magnetic marks made by the coil. In this way, the fishing tool both writes and reads the marks, and an MWD sensor supporting the two modes of operation described above is unnecessary. In a further alternative embodiment, the three dimensional sensor may be incorporated into the stuck point sensor of the prior art. Although, this would not allow the advantageous method described above, it would allow the magnetic marks to be detected with greater accuracy, and without any distorting effects resulting from the speed at which the device is moved.

The invention claimed is:

1. A method of determining the free point in a bore hole, in which magnetic marks are written into the metal casing of the bore hole and read before and after the casing is subjected to a force, comprising:

inserting a retrieval tool into the bore hole for retrieving down hole equipment, the retrieval tool having a device for writing magnetic marks in the casing of the bore hole;

lowering the retrieval tool in the bore hole to the location of the equipment to be retrieved, while writing the magnetic marks in the casing of the bore hole; and raising the retrieval tool and the down hole apparatus, once the retrieval tool has engaged with the down hole apparatus, while operating a magnetic field sensor capable of determining at least one directional component of the magnetic field of the magnetic marks in three dimensions to detect the magnetic marks.

2. The method of claim 1, comprising obtaining more than one directional component of the magnetic field of the magnetic marks, and combining the different directional components to give one or more outputs.

3. The method of claim 2, comprising combining the different directional components to give one or more of the following outputs:

a) the sum of the squares of the x, y and z components;

b) the sum of the squares of the x and y components;

c) the z component only;

d) the sum of the squares of the x, y and z signals, together with the sign of the z signal;

e) a fractional power of a), b) or d); and f) an output derived from one or more of the above.

4. The method of claim 2, comprising using two or more outputs to determine the locations of the magnetic marks in the bore hole.

5. The method of claim 1, wherein the magnetic field sensor is provided in the down hole apparatus.

6. The method of claim 5, comprising transmitting a signal to the down hole apparatus to instruct the magnetic field sensor to begin recording the magnetic field.

7. The method of claim 5, wherein the down hole apparatus is a measurement-while-drilling (MWD) device.

8. The method of claim 5, comprising transmitting data from the magnetic field sensor to the surface.

9. The method of claim 5, comprising transmitting data from the magnetic field sensor to the retrieval tool.

10. The method of claim 1, wherein the magnetic field sensor is provided in the retrieval tool.

11. The method of claim 9, comprising transmitting the data from the magnetic field sensor to the surface.

12. A retrieval tool for retrieving down hole apparatus from a bore hole, and for use in a method of determining the free point in a bore hole in which magnetic marks are written into the metal casing of the bore hole and read before and after the casing is subjected to a force, the tool comprising:

a connector section for engaging with the apparatus to be retrieved; and a magnetic mark writing device for writing magnetic marks into the casing of the bore hole.

13. A retrieval tool according to claim 12, comprising a magnetic field sensor capable of determining at least one directional component of the magnetic field of the magnetic marks in three dimensions to detect the magnetic marks.

14. A retrieval tool according to claim 12, comprising a receiver for receiving data from a magnetic field sensor housed in the apparatus that is to be retrieved.

* * * * *